US005151002A

United States Patent [19]

Theurer et al.

[11] Patent Number: 5,151,002

[45] Date of Patent: Sep. 29, 1992

[54] FREIGHT CAR FOR BULK MATERIAL

[75] Inventors: Josef Theurer, Vienna; Friedrich Oellerer, Linz, both of Austria

[73] Assignee: Franz Plasser Bahnbaumaschinen-Industriegesellschaft m.b.H., Vienna, Austria

[21] Appl. No.: 648,214

[22] Filed: Jan. 31, 1991

[30] Foreign Application Priority Data

Feb. 15, 1990 [AT] Austria ..... 351/90

[51] Int. Cl.[5] ..... B65G 67/02

[52] U.S. Cl. ..... 414/339; 414/502; 414/528

[58] Field of Search ..... 414/339, 526, 528, 326, 414/327, 343, 502; 104/5, 6

[56] References Cited

U.S. PATENT DOCUMENTS

| | | | |
|---|---|---|---|
| 3;064,837 | 11/1962 | Manney | 414/528 |
| 3,498,486 | 3/1970 | Freeman, Jr. | 414/528 X |
| 3,529,738 | 9/1970 | Hunt | 414/528 X |
| 3,842,994 | 10/1974 | Theurer et al. | 414/339 |
| 4,576,538 | 3/1986 | Theurer et al. | 414/339 |
| 4,795,264 | 1/1989 | Riker | 414/339 X |
| 4,809,617 | 3/1989 | Theurer et al. | 414/339 X |
| 4,923,355 | 5/1990 | Mancini | 414/339 |
| 4,925,356 | 5/1990 | Snead et al. | 414/339 |
| 5,029,532 | 7/1991 | Snead | 414/339 X |

FOREIGN PATENT DOCUMENTS

| | | |
|---|---|---|
| 375048 | 6/1984 | Austria . |
| 303037 | 2/1989 | European Pat. Off. . |
| 3420836 | 12/1984 | Fed. Rep. of Germany . |
| 212544 | 8/1984 | German Democratic Rep. . |
| 249298 | 9/1987 | German Democratic Rep. . |
| 583717 | 12/1946 | United Kingdom . |

*Primary Examiner*—David A. Bucci
*Attorney, Agent, or Firm*—Collard & Roe

[57] ABSTRACT

A freight car for incorporation into a freight train of a series of successively arranged like freight cars comprises a carrier frame, a box for storing bulk material, the box having a bottom affixed to the carrier frame and an open top, two longitudinally extending bulk material conveyor arrangements arranged independent of each other, at least one of the conveyor arrangements extending partly along the bottom of the box, and each conveyor arrangement having opposite ends longitudinally spaced from each other and one of the conveyor arrangement ends being higher than the opposite conveyor arrangement end whereby the conveyor arrangement ends at facing ends of the successive freight cars overlap when the freight cars are coupled together.

2 Claims, 1 Drawing Sheet

FREIGHT CAR FOR BULK MATERIAL

BACKGROUND OF THE INVENTION

1. Field of the Invention

The present invention relates to a freight car for incorporation into a freight train of a series of successively arranged like freight cars, successive ones of the freight cars having facing ends which may be coupled together to form the train. The freight car is of the known type comprising a longitudinally extending carrier frame, a longitudinally extending box for storing bulk material, the box having a bottom affixed to the carrier frame and an open top, and a longitudinally extending bulk material conveyor arrangement arranged at least partly along the bottom of the box, the conveyor arrangement having opposite ends longitudinally spaced from each other and one of the conveyor arrangement ends being higher than the opposite conveyor arrangement end whereby the conveyor arrangement ends at facing ends of the successive freight cars overlap when the freight cars are coupled together.

2. Description of the Prior Art

Such a freight car has been disclosed in U.S. Pat. No. 4,576,538, dated Mar. 18, 1986. As described in the patent, when such box cars are coupled together to form a train, the successive conveyor arrangements constitute a continuous conveyor path along the length of the train so that bulk material thrown into the box at one end of the train can be conveyed without further equipment to the box at the opposite end of the train for storing. In this way, the box cars can be successively filled.

U.S. Pat. No. 3,842,994, dated Oct. 22, 1974, also discloses a train of like freight cars with funnel-shaped boxes for storing bulk material. Two conveyor bands are mounted above the open top of each bulk material storage box and these conveyor bands are longitudinally displaceable relative to each other. The ends of adjacent conveyor bands overlap so that the bulk material can be transported from car to car. Bulk material stored in the boxes is discharged therefrom through discharge chutes in the side walls of the boxes. The conveying and discharge arrangements are relatively complex.

Finally, German patent application No. 3,420,836, published Dec. 13, 1984, discloses a track working machine for removing old ballast and providing new ballast. The machine comprises a train of freight cars for storing bulk material, i.e. ballast, each car having endless conveyor bands extending longitudinally along its sides for conveying the ballast. Such freight cars require special loading equipment for charging each conveyor band with the ballast to be conveyed.

SUMMARY OF THE INVENTION

It is the primary object of this invention to improve a freight car of the first-described structure so as to increase its operational possibilities while fully maintaining its loading and discharge capabilities.

The above and other objects are accomplished in such a freight car according to the invention by providing a second longitudinally extending bulk material conveyor arrangement mounted independent of the first conveyor arrangement and arranged for conveying the bulk material in opposite directions, the second conveyor arrangement also having opposite ends longitudinally spaced from each other and one of the second conveyor arrangement ends being higher than the opposite second conveyor arrangement end whereby the second conveyor arrangement ends at facing ends of the successive freight cars overlap when the freight cars are coupled together. The freight car further comprises a longitudinally extending wall separating the box into two halves, the first and the second conveyor arrangements extending independently of each other at least partly along the bottom of the box in the respective halves of the box. This enables the two halves to be used selectively for storing the bulk material and for conveying it therethrough.

This second and independent conveyor arrangement on each freight car provides an additional continuous conveyor path along the freight train, operable independently of the continuous conveyor path constituted by the first conveyor arrangements so that two bulk material transports can be effectuated parallel to, and without interfering with, each other. In this way, two different bulk materials may be conveyed to a track rehabilitation site from one side so that the other side of the site is free to receive other track maintenance machines. It is also possible to convey one type of bulk material, for example ballast, to a track rehabilitation site by operating one of the conveyor arrangements in one direction while at the same time conveying another type of bulk material, for example waste, from the site by operating the other conveyor arrangement in the opposite direction, the two conveyor arrangements operating in a cycle in which successive freight cars are emptied of the one type of bulk material and filled with the other type of bulk material. This provides a more economical operation because a smaller number of freight cars is required for handling the same amount of bulk material, i.e. it is no longer necessary to bring to, and take from, the site the same number of empty card as there are full cars.

This assures an optimal use of the available storage capacity by enabling successive box cars to be simultaneously emptied, for example of new ballast, and filled, for example with waste coming from a ballast renewal site, beginning with the box car farthest removed from the site.

A respective variable-speed drive may be provided for each conveyor arrangement whereby each conveyor arrangement may be switched from a slow bulk material storing speed to a faster bulk material transporting speed. In this way, the speed of each conveyor arrangement may be optimally adjusted to the required task of storing or transporting the bulk material, depending on whether it is desired to charge or discharge the bulk material.

BRIEF DESCRIPTION OF THE DRAWING

The above and other objects, advantages and features of the present invention will become more apparent from the following detailed description of certain now preferred embodiments thereof, taken in conjunction with the accompanying schematic drawing wherein.

DETAILED DESCRIPTION OF PREFERRED EMBODIMENTS

Figure 1:
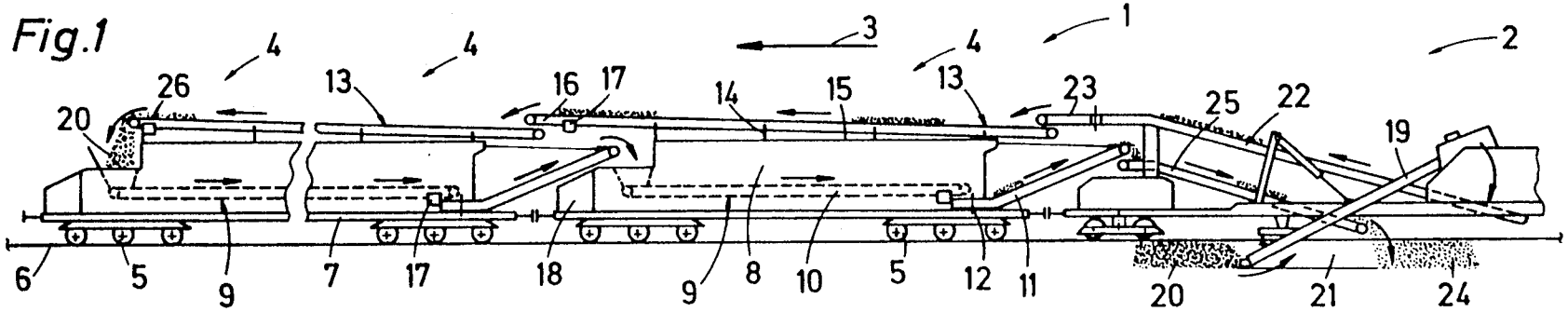
FIG. 1 is a side elevational view of a train comprised of a series of successive freight cars coupled to a ballast cleaning machine.

Referring now to the drawing and first to FIG. 1, there is shown freight train 1 comprised of a series of successively arranged like freight cars 4. Successive freight cars have facing ends which are coupled together to form the train, a first freight car 4 being coupled to ballast cleaning machine 2 and preceding the ballast cleaning machine in the operating direction of the machine, indicated by arrow 3. The opposite ends of each freight car are supported on track 6 by undercarriages 5, and each freight car 4 comprises longitudinally extending carrier frame 7 and longitudinally extending box 8 for storing bulk material, the box having a bottom affixed to the carrier frame and an open top. It further comprises first longitudinally extending bulk material conveyor arrangement 9 arranged at least partly along the bottom of the box, the conveyor arrangement consisting of bottom conveyor band 10 extending along the bottom of the box and adjacent transition conveyor band 11 ascending from the bottom conveyor band and projecting from the freight car end towards the facing end of a successive car. The transition conveyor band is pivotal about vertical axis 12. Conveyor arrangement 9 has opposite ends longitudinally spaced from each other and the projecting conveyor arrangement end is higher than the opposite conveyor arrangement end whereby the conveyor arrangement ends at facing ends of the successive freight cars overlap when the freight cars are coupled together.

According to the invention, freight car 4 carries a second longitudinally extending bulk material conveyor arrangement 13 mounted independent of first conveyor arrangement 9, and the second conveyor arrangement also has opposite ends longitudinally spaced from each other and one of the second conveyor arrangement ends being higher than the opposite second conveyor arrangement end whereby the second conveyor arrangement ends at facing ends of the successive freight cars overlap in transition area 16 when the freight cars are coupled together. As indicated by short horizontal arrows, the first and second conveyor arrangements are arranged for conveying the bulk material in opposite directions, and second conveyor arrangement 13 is mounted above the open box top. Drives 17 receiving energy from power plant 18 move the conveyor arrangements in their respective conveying directions.

Furthermore, in this embodiment, the second conveyor arrangement is detachably connected to the two longitudinally extending side walls 15 of box 8 by detachable supports 14, and is centered therebetween. As shown, the opposite ends of second conveyor arrangement 13 project the same distance from undercarriages 5 supporting the freight car ends.

In operation, train 1 is propelled to a track rehabilitation site, boxes 8 of freight cars 4 being filled with fresh ballast. Ballast excavation chain 19 of ballast cleaning machine 2 conveys excavated ballast 20 to a ballast cleaning screen which separates the cleaned ballast from waste, the latter being discharged onto waste conveyor 22. The waste conveyor conveys the waste to upper conveyor arrangement 13 of freight car 4 immediately preceding the ballast cleaning machine in the operating direction and coupled thereto. Waste conveyor 22 has an end overlapping an adjacent end of conveyor arrangement 13 and pivotally hinged to the waste conveyor for being adjusted into an inoperative position when the ballast cleaning machine is moved from site to site.

While old ballast waste 20 is conveyed by successive conveyor arrangements 13 towards leading freight car 4 in the operating direction, new ballast 24 is simultaneously conveyed from the full freight cars by conveyor arrangements 9 towards ballast cleaning machine 2 where it is fed from the high end of conveyor arrangement 9 adjacent thereto to subtending conveyor band 25 on the ballast cleaning machine for conveyance into ballast bed gap 21 created by the excavation of the old ballast. All the boxes of the successive freight cars of train 1 are thus emptied simultaneously as successive overlapping conveyor arrangements 9 convey new ballast 24 along a continuous conveyor path. Empty space is first provided in box 8 of leading freight car 4, and this is filled continuously with old ballast waste 20 conveyed by conveyor arrangements 13 to leading end 26. This leading end of conveyor arrangement 13 in leading freight car 4 does not project beyond the freight car end but the conveyor arrangement is shortened so that leading conveyor arrangement end 26 will discharge old ballast waste 20 onto underlying conveyor arrangement 9. The speeds of drives 17 of conveyor arrangements 9 and 13 may be varied for adjustment to respective filling conditions in boxes 8 of freight cars 4. Variable-speed drive 17 for each conveyor arrangement enables each conveyor arrangement to be switched from a slow bulk material storing speed to a faster bulk material transporting speed.

Figure 2:
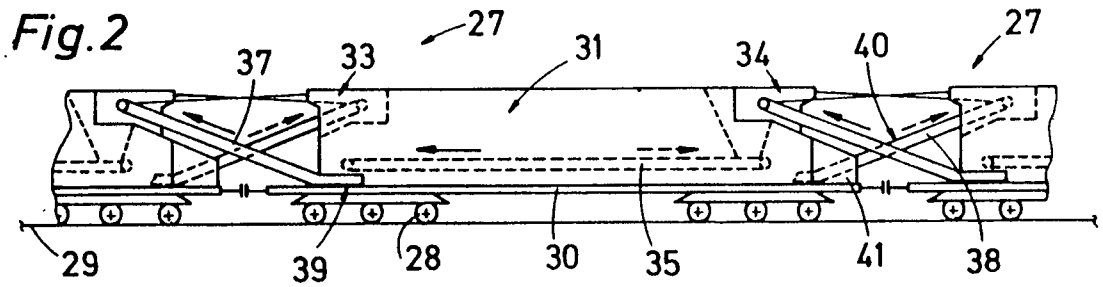
FIG. 2 is a fragmentary side elevational view of such a train, showing another embodiment of the freight car.
Figure 3:
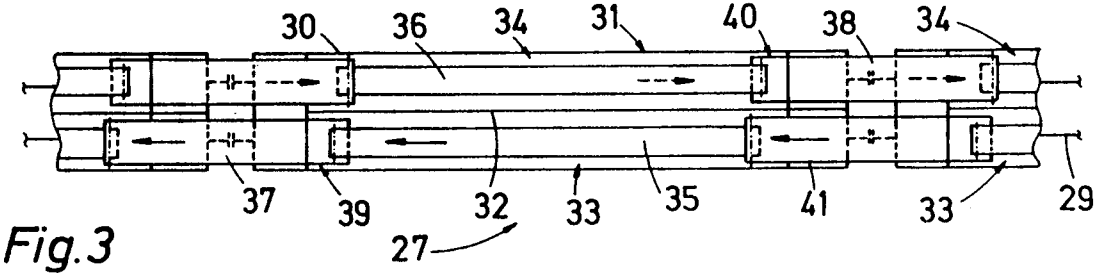
FIG. 3 is a top view of FIG. 2.

FIGS. 2 and 3 illustrate freight car 27 comprising longitudinally extending wall 32 separating box 31 into two halves 33, 34, the first and the second conveyor arrangements 39, 40 extending independently of each other at least partly along the bottom of the box in respective halves 33, 34 of box 31. As in the first described embodiment, the freight car comprises carrier frame 30 supported at its ends by undercarriages 28 on track 29. Box 31 is affixed to the carrier frame and each conveyor arrangement 39, 40 is comprised of bottom conveyor band 35, 36 and ascending transition conveyor band 37, 38 having a projecting end higher than the opposite end of the conveyor arrangement. Drive 41 enables the conveyor bands to be driven in opposite directions, as indicated by short horizontal arrows shown in full and broken lines, respectively.

As in the embodiment of FIG. 1, freight cars 27 may precede a ballast cleaning machine in the operating direction and a reversing conveyor band mounted in the leading freight car between coplanar conveyor arrangements 39, 40 so that bulk material conveyed by one of the conveyor arrangements may be transferred for conveyance in the opposite direction by the other conveyor arrangement. At the beginning of an operation, both box halves 33, 34 of freight cars 27 are filled with new ballast which is conveyed to the trailing ballast cleaning machine in the directions of the arrows shown in FIG. 3, the new ballast being transferred from conveyor arrangement 39 to conveyor arrangement 40 by the reversing conveyor (not shown) in a leading freight car (to the left of FIG. 2). Since all the successive freight cars are thus being emptied along a continuous conveyor path, an empty space is created immediately in box half 33 of freight car 27 immediately preceding the ballast cleaning machine (not shown to the right of FIG. 2). The old ballast waste is simultaneously conveyed to this empty space (similarly to the embodiment of FIG. 1) and conveyed along the continuous conveyor path, as the new ballast is conveyed therealong to create successive empty spaces. When the last new ballast has been conveyed out of box half 34 of freight car 27 immediately preceding the ballast cleaning machine, all the box halves have been filled with old ballast waste.

Figure 4:
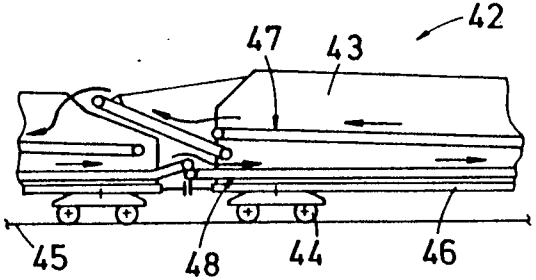
FIG. 4 is another fragmentary side elevational view showing a further embodiment of the freight car.

FIG. 4 fragmentarily shows a freight car 42 whose box is affixed to carrier frame 46 supported by undercarriages 44 on track 45. In this embodiment, first conveyor arrangement 47 has a conveyor band forming a bottom wall of the box 43 and an ascending conveyor band projecting from an end of the freight car. This conveyor arrangement serves for conveying bulk material to and from the box as well as for storing it in the box. A second conveyor arrangement 48 extends below the first conveyor arrangement and forms a continuous conveyor path with adjacent like conveyor arrangements along a succession of freight cars. The second conveyor arrangement serves primarily for conveying bulk material along the train. Boxes 43 of freight cars 42 are filled with new ballast at the beginning of the operation, and the operation proceeds in the same manner as described in conjunction with the embodiments of FIGS. 1 to 3.

What is claimed is:

1. A freight car for incorporation into a freight train of a series of successively arranged like freight cars, successive ones of the freight cars having facing ends which may be coupled together to form the train, the freight car comprising (a) a longitudinally extending carrier frame, (b) a longitudinally extending box for storing bulk material, the box having a bottom affixed to the carrier frame and an open top, (c) a longitudinally extending wall separating the box into two halves, (d) a first longitudinally extending bulk material conveyor arrangement, the conveyor arrangement having opposite ends longitudinally spaced from each other and one of the conveyor arrangement ends being higher than the opposite conveyor arrangement end whereby the conveyor arrangement ends at facing ends of the successive freight cars overlap when the freight cards are coupled together, (e) a second longitudinally extending bulk material conveyor arrangement, the second conveyor arrangement also having opposite ends longitudinally spaced from each other and one of the second conveyor arrangement ends being higher than the opposite second conveyor arrangement end whereby the second conveyor arrangement ends at facing ends of the successive freight cards overlap when the freight cards are coupled together, (f) the first and the second conveyor arrangements extending independently of each other at least partly along the bottom of the box in the respective halves of the box, and (g) drive means connected to the conveyor arrangements and arranged to drive the conveyor arrangements in opposite directions.

2. The freight car of claim 1, wherein the drive means comprises a respective variable-speed drive for each conveyor arrangement whereby each conveyor arrangement may be switched from a slow bulk material storing speed to a faster bulk material transporting speed.

* * * * *